US006499466B2

(12) United States Patent
Lee

(10) Patent No.: US 6,499,466 B2
(45) Date of Patent: Dec. 31, 2002

(54) DOUBLE WALLED FUEL RAIL

(75) Inventor: Ki-Ho Lee, Windsor (CA)

(73) Assignee: Siemens VDO Automotive Inc., Tilbury (CA)

( * ) Notice: Subject to any disclaimer, the term of this patent is extended or adjusted under 35 U.S.C. 154(b) by 0 days.

(21) Appl. No.: 09/969,419

(22) Filed: Oct. 2, 2001

(65) Prior Publication Data

US 2002/0046735 A1 Apr. 25, 2002

Related U.S. Application Data

(60) Provisional application No. 60/243,187, filed on Oct. 25, 2000.

(51) Int. Cl.[7] ..... F02M 37/04

(52) U.S. Cl. ..... 123/456; 123/516; 123/468

(58) Field of Search ..... 123/456, 468, 123/469, 516, 518

(56) References Cited

U.S. PATENT DOCUMENTS

| | | | | | |
|---|---|---|---|---|---|
| 4,159,698 | A | * | 7/1979 | Berenbaum | 123/516 |
| 5,076,242 | A | * | 12/1991 | Parker | 123/514 |
| 5,239,964 | A | * | 8/1993 | Diener et al. | 123/456 |
| 5,295,467 | A | * | 3/1994 | Hafner | 123/456 |
| 5,359,976 | A | * | 11/1994 | Nakashima et al. | 123/516 |
| 6,079,391 | A | * | 6/2000 | Eyberg et al. | 123/456 |

* cited by examiner

*Primary Examiner*—Thomas N. Moulis

(57) ABSTRACT

A fuel delivery system comprises a fuel conduit having a gas permeable wall. A gas conduit is in communication with the fuel conduit. Gaseous fuel and liquid fuel are communicated through fuel conduit. Gaseous fuel permeating through the gas permeable wall is captured and channeled by gas conduit. Gaseous fuel may be passed to an air intake manifold and consumed by engine combustion.

19 Claims, 3 Drawing Sheets

DOUBLE WALLED FUEL RAIL

This application claims priority to United States Provisional Patent Application Serial No. 60/243,187 filed on Oct. 25, 2000.

BACKGROUND OF THE INVENTION

This invention relates to a method and system for fuel delivery that limits the emission of fuel fumes into the environment.

Current fuel delivery systems provide fuel to a vehicle's combustion chambers through a fuel rail that channels fuel from the fuel tank to fuel injectors above the chambers. While many fuel rails are constructed of metal, more recently, manufacturers have commenced using plastic fuel rails to distribute fuel to the injectors. Plastic fuel rails are lighter and casier to recycle with other plastic components associated with the vehicle engine. Plastic fuel rails, however, are porous and consequently permit fumes or vapor from the liquid fuel to permeate into the environment. Higher emission standards make the emission of fumes through the rail a source of concern for manufacturers using plastic fuel rails.

Manufacturers have attempted to address this environmental concern by using various coatings to prevent fumes from entering the environment. For the most part, these coatings have been ineffective or extremely expensive to employ.

A need therefore exists for a fuel delivery system that limits the exhaust of fumes into the environment while still permitting manufacturers to employ plastic fuel distribution systems.

SUMMARY OF THE INVENTION

The invention comprises a fuel delivery system. The system has a fuel rail or conduit that has a wall formed of plastic. A gas rail or conduit surrounds this wall such that any gas vapor permeating through the fuel conduit passes into the gas conduit. Hence, while vapor may pass through the fuel conduit into the gas conduit, the remaining fuel continues to the fuel injector and ultimately the vehicle engine. In this way, the fuel conduit transports fuel to a vehicle's combustion chamber without significant environmental emissions.

The gas conduit surrounds the fuel conduit. Essentially, some way of directing the vapor from the gas conduit to a source such as the engine may be utilized. Much work has been done in recent years in capturing and processing vapor, and any of the ways of moving the vapor may be utilized with this invention. Particular embodiments will be disclosed. However, other methods may also be utilized.

The outer wall of the gas conduit is also preferably formed of plastic. Thus, the outer wall of the gas conduit also will potentially allow permeation of fuel vapor. However, by maintaining a lower pressure compared to atmosphere in the gas conduit, the likelihood of significant vapor permeation will be reduced or eliminated.

In essence, the fuel delivery system communicates a fuel through the fuel conduit. Any vapor that passes through a wall of the fuel conduit passes into a gas conduit. Rather than permitting any vapor to enter the environment, the invention recirculates the vapor to the vehicle engine or otherwise processes the vapor.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

The invention comprises a fuel delivery system that permits any fuel vapor in a fuel conduit which permeates a plastic wall, to pass into a gas conduit. The fuel in the fuel conduit continues to pass to the fuel injectors while the permeated vapor is otherwise processed. The invention thereby prevents such fumes from entering the environment.

Figure 1:
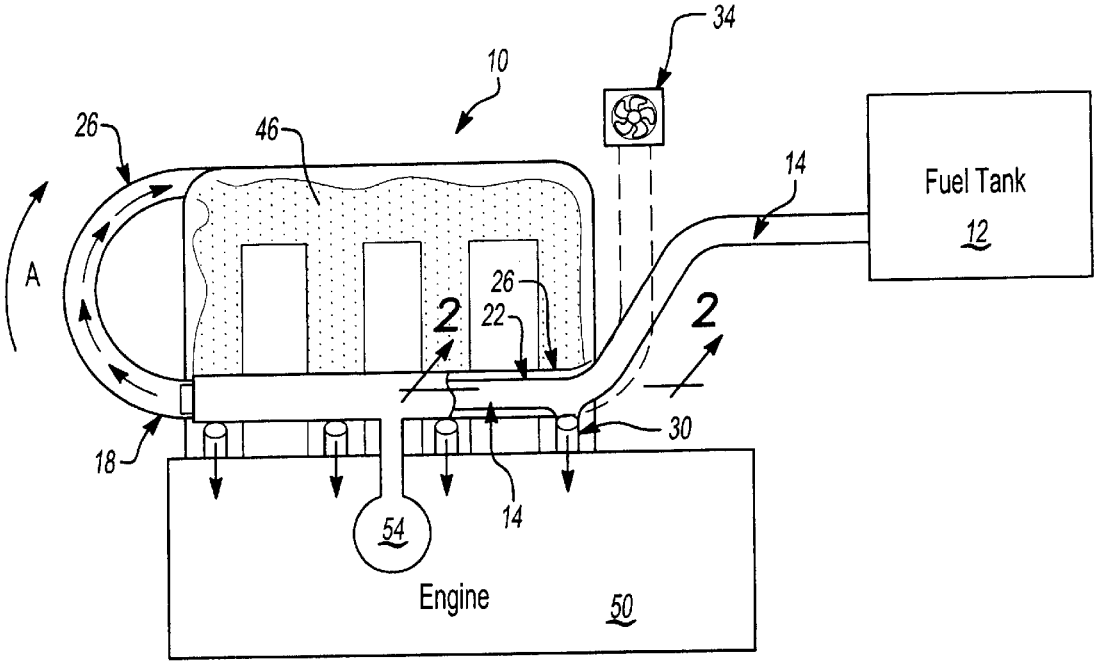
FIG. 1 shows an embodiment of the invention, including a fuel conduit, a gas conduit, and a fuel injector.
Figure 2:
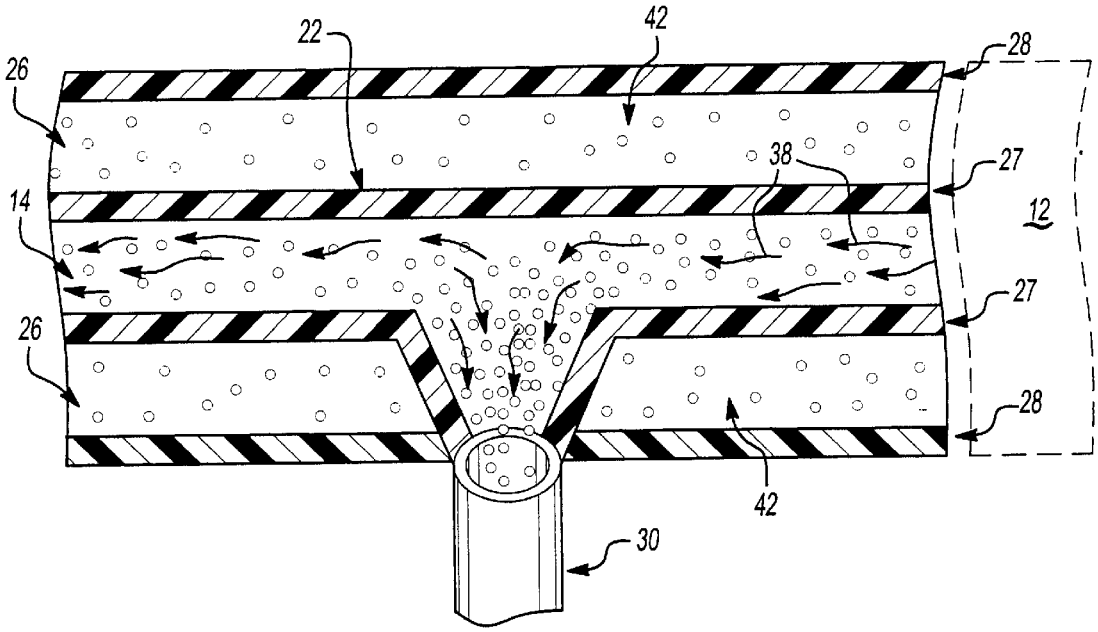
FIG. 2 illustrates a cross sectional view of the gas conduit and fuel conduit of FIG. 1.

FIG. 1 illustrates an embodiment of invention 10 comprising fuel conduit 14, inner plastic wall 22, gas conduit 26, and at least one fuel injector 30. As seen in FIG. 2, fuel passing from the fuel tank 12 travels through fuel conduit 14 and ultimately to fuel injector 30 and other fuel injectors of engine 50 as known. Gas conduit 26 envelopes fuel conduit 14. Both gas conduit 26 and fuel conduit 14 may be made of plastic.

Fuel conduit 14 carries fuel having liquid form 38 and vapor form 42. Inner wall 22 may allow some fuel vapor 42 to escape fuel conduit 14. Gas conduit 26 may have a lower pressure than fuel conduit 14.

As shown in FIGS. 1 and 2, fuel vapor 42 may travel through gas conduit 26 into gas reservoir 56, such as a canister or plenum volume, and along the path of arrow A into air intake manifold 46. Moreover, a purge control device 34, such as a crankcase ventilation system, may purge the fuel vapor in gas conduit 26 and gas reservoir 56 to an acceptable destination. For example, air intake manifold 46 may evenly distribute vapor 42 from gas reservoir 56 to the air intake ports of air intake manifold 46. Air and the fuel vapor channeled through gas conduit 26 are then channeled through air intake manifold 46 into the combustion chamber of the cylinder. Hence, air intake manifold 46 not only introduces air into combustion chamber as known but also vapor form 42 from gas conduit 26. Air and fuel vapor form 42 combine and combust with liquid form 38 of gas. Vapor 42 is thus consumed by engine 50 rather than permitted to escape into the environment. Gas reservoir 56 ensures distribution of vapor 42 evenly through air intake manifold 46 so as to avoid concentration of vapor 42 in a particular cylinder. The plenum volume of existing air intake systems may be employed with minor connection changes that may be made by one of ordinary skill in the art.

Figure 3:
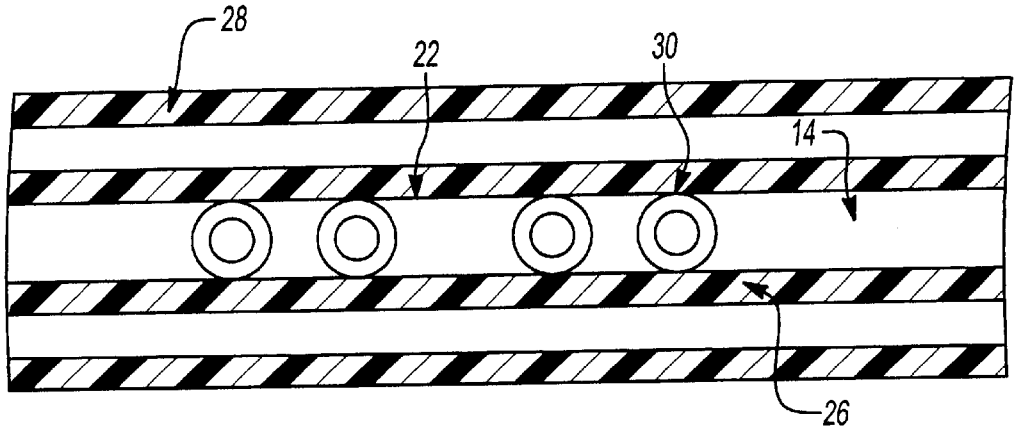
FIG. 3 illustrates a plan view of the fuel conduit and gas conduit of FIG. 1 and FIG. 2.

FIG. 3 illustrates a plan view of fuel conduit 14 and gas conduit 26. Shown are inner diameter wall 27 of gas conduit 26, which also serves as the wall 22 of fuel conduit 14. Outer diameter wall 28 is also shown. Fuel conduit shares a common wall 22 with gas conduit 26, and is preferably enclosed by gas conduit 26.

Figure 4:
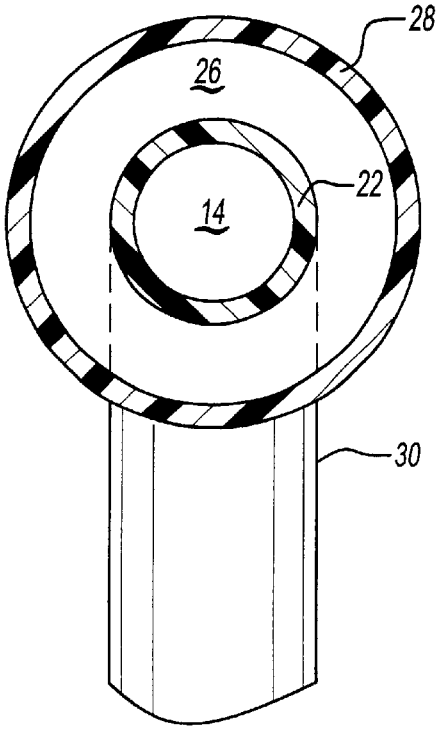
FIG. 4 illustrates an alternative view of the embodiment of FIG. 3.

FIG. 4 shows a cross-section of fuel conduit 14 and gas conduit 26. As illustrated, gas conduit 26 envelopes fuel conduit 14, sharing wall 22. Fuel injector 30 is shown in communication with fuel conduit 14.

Figure 5:
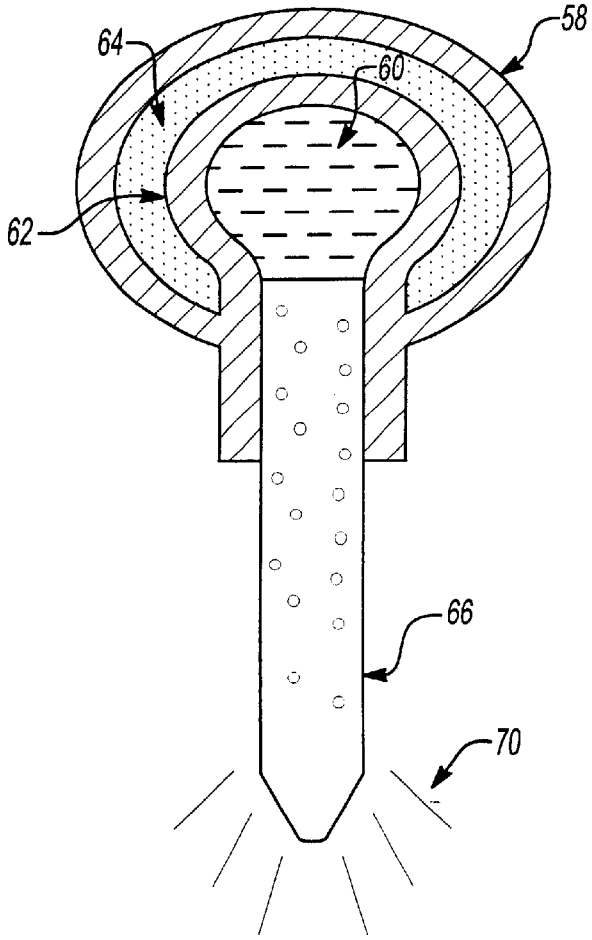
FIG. 5 illustrates a view of another embodiment of the fuel conduit and gas conduit.

FIG. 5 illustrates a cross section of another embodiment of the invention, including fuel conduit 60 and gas conduit 64. As shown in this embodiment, gas conduit 64 does not entirely envelope fuel conduit 60. Moreover, while gas conduit has outer diameter wall 58, this wall may be formed integrally with inner wall 62, which itself serves to form fuel conduit 60. Fuel injector 66 is also shown communicating fuel by spray 70 into a combustion chamber (not shown) as known.

Figure 6:
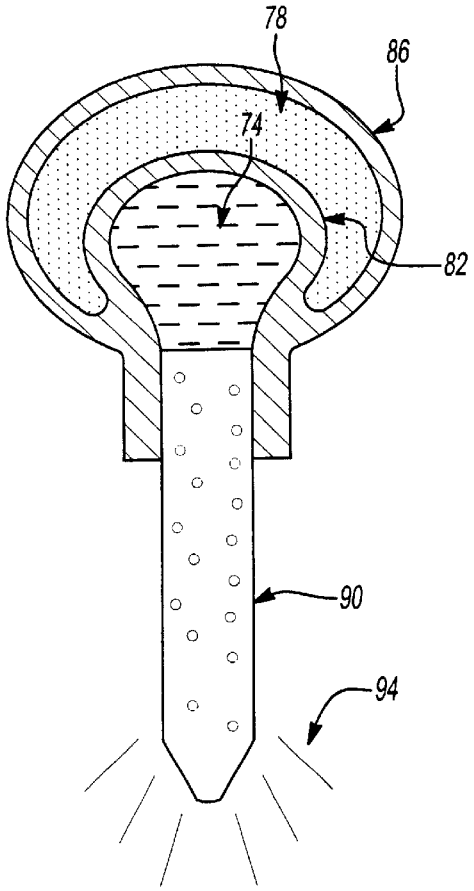
FIG. 6 illustrates another embodiment of the fuel conduit and gas conduit.

FIG. 6 illustrates another embodiment of the invention where by gas conduit 78 shares even less of the inner wall 82 then other embodiments. Here, fuel conduit 74 has wall 82, which also serves as an inner diameter wall of gas conduit 78 over a portion of conduit 78. Gas conduit 78 also has outer diameter wall 86. Fuel injector 90 with fuel spray 94 is also illustrated. The area of the cross section of the fuel conduit and gas conduit may be determined by manufacturing method and the required amount of fuel fed to the engine as known.

Figure 7:
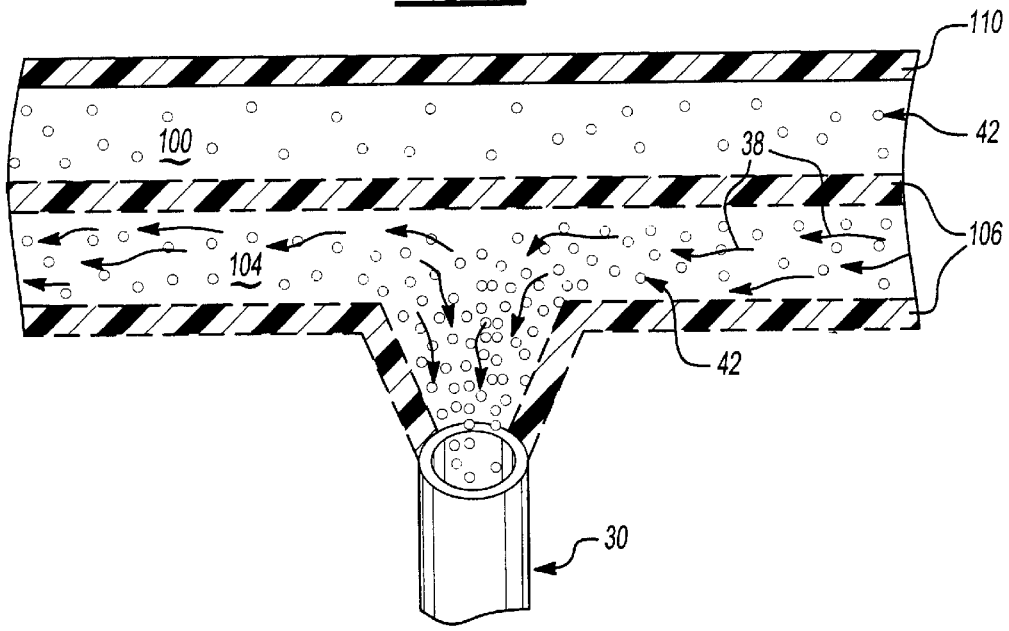
FIG. 7 shows another embodiment of the invention.

FIG. 7 shows another embodiment of the invention. Here, gas conduit 100 only shares a portion of gas permeable wall 106. Wall 110 serves to direct vapor 42 for its ultimate disposal. Gas permeable wall 106 directs both vapor 42 and liquid form 38 to fuel injector 30. A portion of vapor 42 may escape into environment. However, ensuring a pressure lower than atmospheric in gas conduit 100 through purge control device 34 or other available device will cause vapor 42 to be drawn to gas conduit 100 more than to environment. This particular embodiment provides limited recapture of vapor 42 but may be easier to mold.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A fuel delivery system comprising:

a plastic fuel conduit having an outer fuel wall, for communicating a fuel comprising a vapor state fuel and a liquid state fuel;

a gas conduit at least partially surrounding said outer fuel wall; and at least one fuel injector in communication with said fuel conduit wherein said vapor state fuel communicates from said plastic fuel conduit through said outer fuel wall to said gas conduit.

2. The fuel delivery system of claim 1 wherein said fuel conduit and said gas conduit share said outer fuel wall.

3. The fuel delivery system of claim 2 wherein said gas conduit has an inner diameter wall and an outer diameter wall wherein said outer fuel wall at least partially comprises said inner diameter wall.

4. The fuel delivery system of claim 1 including a purge control device in communication with said gas conduit for moving gas through said gas conduit.

5. The fuel delivery system of claim 4 wherein said purge control device comprises a crankcase ventilation system.

6. The fuel delivery system of claim 1 including an air intake manifold in communication with said gas conduit.

7. The fuel delivery system of claim 1 including a gas reservoir in communication with said gas conduit for collecting gas.

8. The fuel delivery system of claim 1 wherein pressure in said gas conduit is less than atmospheric.

9. The fuel delivery system of claim 8, wherein said gas conduit is formed of plastic.

10. A fuel delivery system comprising:

a plastic fuel conduit having an outer fuel wall, communicating a fuel in both a liquid and a vapor state;

a gas conduit at least partially surrounding said outer fuel wall;

at least one fuel injector in communication with said fuel conduit; and wherein said fuel vapor that diffuses through said outer fuel wall is captured in said gas conduit.

11. The fuel delivery system of claim 10 wherein said fuel conduit and said gas conduit share said outer fuel wall.

12. The fuel delivery system of claim 11 wherein said gas conduit has an inner diameter wall and an outer diameter wall wherein said outer fuel wall at least partially comprises said inner diameter wall.

13. The fuel delivery system of claim 10 including a purge control device in communication with said gas conduit for moving gas through said gas conduit.

14. The fuel delivery system of claim 13 wherein said purge control device comprises a crankcase ventilation system.

15. The fuel delivery system of claim 10 including an air intake manifold in communication with said gas conduit.

16. The fuel delivery system of claim 10 including a gas reservoir in communication with said gas conduit for collecting gas.

17. The fuel delivery system of claim 10 wherein pressure in said gas conduit is less than atmospheric.

18. The fuel delivery system of claim 1 wherein said vapor state fuel communicates within said gas conduit along the same general direction as said liquid state fuel within said plastic fuel conduit.

19. The fuel delivery system of claim 18 wherein said vapor state fuel within said gas conduit and said liquid state fuel within said plastic fuel conduit are communicated to an engine for consumption.

* * * * *